United States Patent [19]

Goulet

[11] Patent Number: 4,901,774

[45] Date of Patent: Feb. 20, 1990

[54] APPARATUS FOR MAKING FISHING LURES

[76] Inventor: David J. Goulet, 1609 Fifth Ave., Moline, Ill. 61265

[21] Appl. No.: 345,867

[22] Filed: May 1, 1989

[51] Int. Cl.[4] ..... B21F 1/06

[52] U.S. Cl. ..... 140/104; 43/42.53

[58] Field of Search ..... 43/42.53; 140/104

[56] References Cited

U.S. PATENT DOCUMENTS

| | | | |
|---|---|---|---|
| 2,006,355 | 7/1935 | Howell | 140/104 |
| 2,438,984 | 2/1945 | Adams | 140/104 |
| 3,221,779 | 12/1965 | Noel | 140/104 |
| 3,578,035 | 5/1971 | Parker | 140/104 |
| 4,149,335 | 4/1979 | Duescher | 43/42.53 |
| 4,421,145 | 12/1983 | Broberg | 140/104 |

*Primary Examiner*—Nicholas P. Godici
*Assistant Examiner*—Michael W. Starkweather
*Attorney, Agent, or Firm*—Henderson & Sturm

[57] ABSTRACT

Apparatus for forming closed loops or eyes at opposite ends of a length of wire especially useful in the manufacture of fishing lures wherein a plurality of attractive objects (beads, etc.) are strung on the wire between the closed loops or eyes. The apparatus provides mechanism for forming one straight end portion of the wire into a generally V shape to provide an open loop at the apex of the V, following which a twisting mechanism engages and twists the loop to wrap one leg of the V several times about the other leg so as to close the loop and thereby to produce an eye. The wire is turned end for end and the operation of the mechanism is repeated to form an eye at the other end of the wire.

17 Claims, 3 Drawing Sheets

Fig. 1
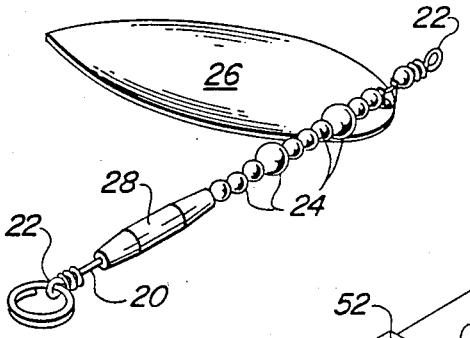
Fig. 2
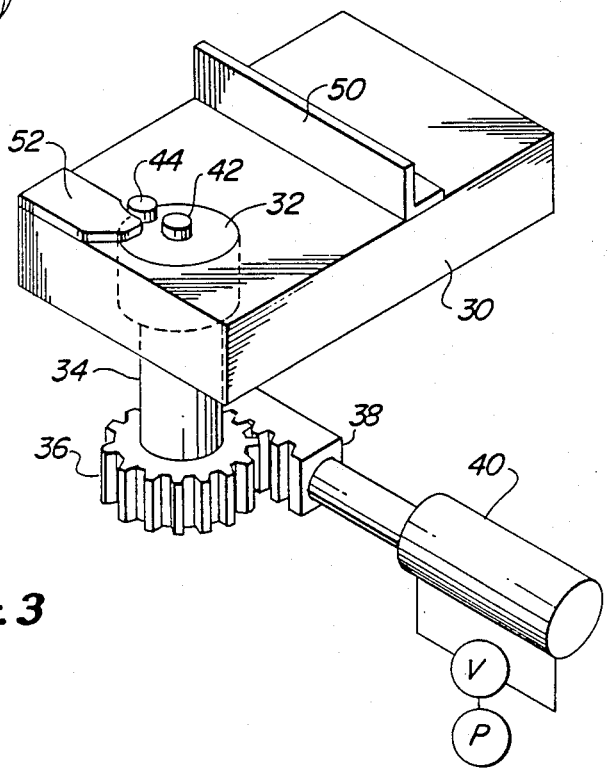
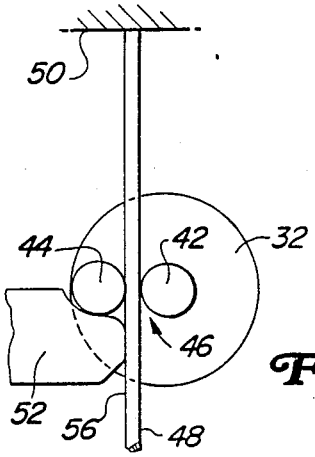
Fig. 3
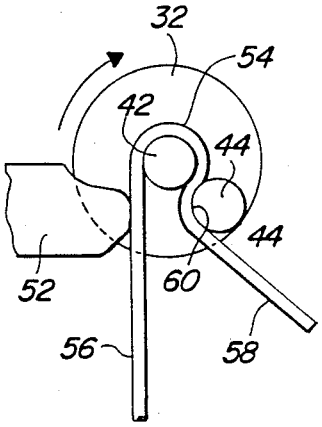
Fig. 4
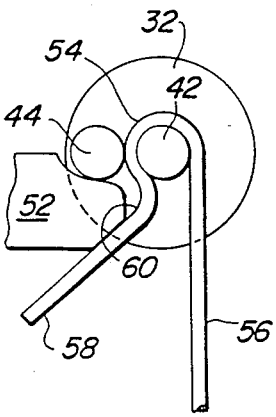
Fig. 5
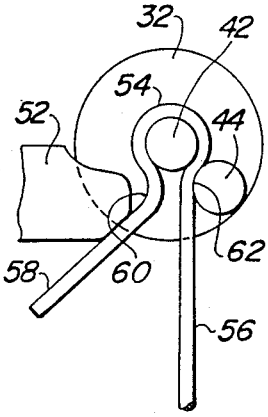
Fig. 6

APPARATUS FOR MAKING FISHING LURES

BACKGROUND AND GENERAL NATURE OF THE INVENTION

Fishing lures have been conventionally produced on the basis of using a length of wire having integral eyes at its opposite ends for attachment of lines, hooks, etc. Also conventionally, the wire will include threaded thereon between the eyes a plurality of beads, etc. In most instances, the forming of an eye at one end is performed in the absence of the beads, etc., but, before the second eye can be formed, the beads must be strung on the wire, thus making formation of the second eye a fairly difficult process. Moreover, many lures are handmade and the eyes are formed by hand-held twisters and therefore lack uniformity, symmetry and adequate twists. According to the present invention, the disadvantages of prior manufacture are eliminated and the "backbone" wire of the lure is provided at opposite ends with closed eyes that are uniform, symmetrical and feature a positive multi-coil wrap that assures a product that has long life, is easy to manufacture and is made available to the market at relatively low cost.

A feature of the invention resides in the preliminary shaping of a straight length of wire, one end at a time, into a modified V shape including a pair of coplanar legs that converge to the apex of the V and which meet the apex, which is rounded to form an open loop, at small radii so that the legs are symmetrical about an axis that bisects the angle between the legs and passes centrally through the open loop. The legs are then held and guided and a rotating twister engages the loop and rotates about an axis generally concident with one leg of the V whereby to wrap the other leg several times about the one leg, thus closing the loop to form an eye securely closed by the multi-wrap of one leg about the other. The mechanism for forming the V produces the rounded loop as well as the radii at the junctions of the legs with the loop. The twisting mechanism includes holding and guide means for the legs so that the loop projects for engagement with a pintle on a rotatable twister shaft. The guide means functions to control the wrap of one leg about the other and the holding means is provided at one face with a cavity that accommodates the successive coils of the wrapped wire as the twisting operation is performed. The opposite face of the holding and guide means has a recess for accommodating a bead on the wire so that formed eye is close to the nearest bead and thus the set of beads is relatively closely confined between the eyes at opposite ends of the wire.

Further features and objects of the invention will appear as a preferred embodiment of the invention is disclosed in the ensuing description and accompanying drawings.

DESCRIPTION OF THE DRAWING FIGURES

FIG. 1 is a view of a representative fishing lure.

FIG. 2 is a perspective of the loop-forming mechanism.

FIGS. 3 through 6 illustrate successive steps in the shaping of a modified V at an end of the wire.

FIG. 17 is a view of the completed eye in the wire.

DETAILED DESCRIPTION OF A PREFERRED EMBODIMENT OF THE INVENTION

Figure 8:
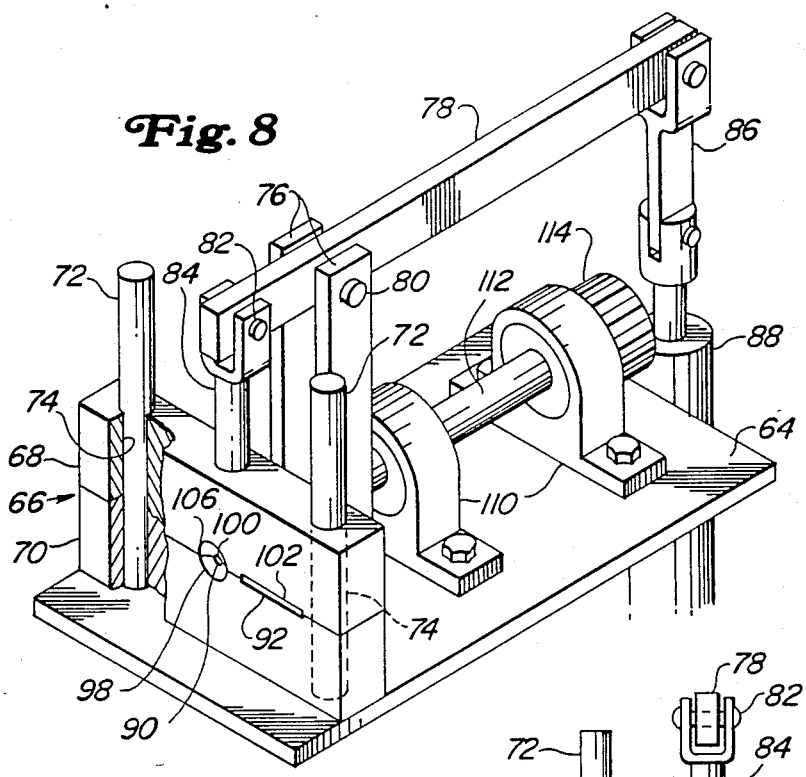
FIG. 8 is a perspective of the twisting mechanism.

Reference will be had first to FIG. 1 for a description of a generally typical fishing lure of the type made up of a plurality of objects strung on a straight length of wire 20 provided at its opposite ends with closed eyes 22 for the attachment of lines, hooks, etc. (not shown). Among the objects strung on the wire are beads 24, a spinner blade 26 and a sleeve 28. According to the present invention, one eye 22 is formed before the beads, etc., are strung and the other eye is formed after the stringing.

FIG. 2 best shows the basics or the shaping of loop-forming mechanism as comprising a base or support 30 which journals a movable member in the form of shaping head 32. This head is provided here as the upper end of a vertical shaft 34 suitably journalled in the base and projecting below the base to a pinion 36 keyed to the shaft and meshing with a rack 38. The particular orientation of the parts as horizontal, vertical, etc., is preferred but is not a limitation on the invention. Also, the parts are shown generally pictorially, omitting bearings, supports, etc., that may take many forms and thus do not constitute significant parts of the invention beyond serving to perform the inventive functions. The rack is power-operated for reciprocation by any suitable power means, here suggested as being an air cylinder 40 controlled by a suitable valve. The arrangement is such that the cylinder when actuated turns the shaft 34 and thus the head 32 through an angular range to be described later. Further, the head is turned through this range and reversed through the same range, also as will appear later.

Reference is now had to FIGS. 3–6 for a description of the formation in one end of the wire of shapes preliminary to the ultimate forming of an eye 22.

FIG. 3 is the starting position and shows the head 32 as having a central pin 42 coaxial with the shaft 34 and a stud 44 offset radially from the pin so as to afford a space 46 for receiving a straight length of wire 48 that will ultimately become the wire ("backbone" of the lure). This wire is preferably of stainless steel and of a diameter less than that shown in FIGS. 3–6 since the latter are enlarged in order to simplify and clarify the explanation. A stop 50 determines the extent to which the wire can be inserted between the pin and stud and the position of the stop is of course determined by the length of wire to be consumed in the bending and twisting operations. An abutment member 52 is fixed to the top of the base in proximity to and below (as seen in FIGS. 3–6) and stud 44 in position to engage the wire 48 from the left (as seen by the reader).

The wire in the status seen in FIG. 3 may be hand held and the mechanism actuated to cause the head 32 to turn clockwise. The pin 42 of course retains fixed position as a mandrel even though it turns with the head 32. The stud 44 engages that portion of the wire projecting past the pin and stud to the stop 50 and bends that portion of the wire about the pin to preliminarily form a loop 54. That portion of the wire to the left of the pin will become one leg 56 of a modified V ultimately formed in the wire, and the other leg of the V is the tail 58 of the wire portion shaped by travel of the stud 44. As best seen in FIG. 4, the stud is cylindrical in section and thus forms a small radius 60. In the preferred embodiment, arcuate or angular travel of the stud between FIGS. 3 and 4 is greater than 180°, preferably on the order of 200° to 250°, here about 220°. As seen in FIG. 4, the general configuration of the formed or shaped wire is somewhat like an incomplete R. The leg 56 remains straight at this point because of the abutment 52. The length of the tail or second leg 58 is predetermined on the basis of what is needed in the ensuing twisting operation.

Figure 7:
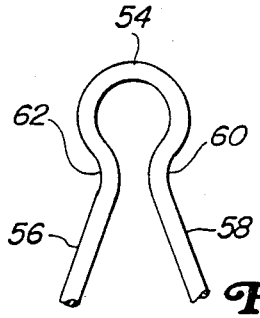
FIG. 7 is a view of the formed loop before twisting.

After the stage of FIG. 4, the wire is removed and the head 32 returns to its starting position (FIG. 1) from the end or stop position depicted in FIG. 4. That is, the start position of FIG. 1 is repeated in FIG. 5, but the "R-formed" wire is reversed so that the leg or tail 58 is now to the left of the pin and between the pin and the abutment 52, which is rounded as shown in accommodate the radius 60. The head is again turned clockwise through the aforesaid range and engages the leg 56 close to its junction with the incomplete loop 54 and thus forms a second radius 62. The wire as now shaped is seen by itself in FIG. 7 as being a modified V having the rounded apex formed by the loop 54 and further having the coplanar legs 56 and 58 which diverge from the loop 54 via their respective radii 60 and 62. The loop is, of course, coplanar with the legs.

Figure 11:
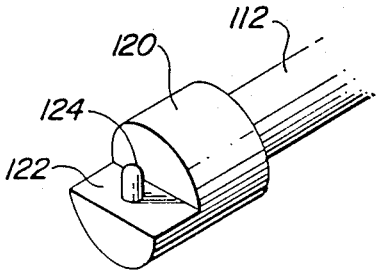
FIG. 11 is a fragmentary view showing the connection between one of members and the lever that raises and lowers it.
Figure 12:
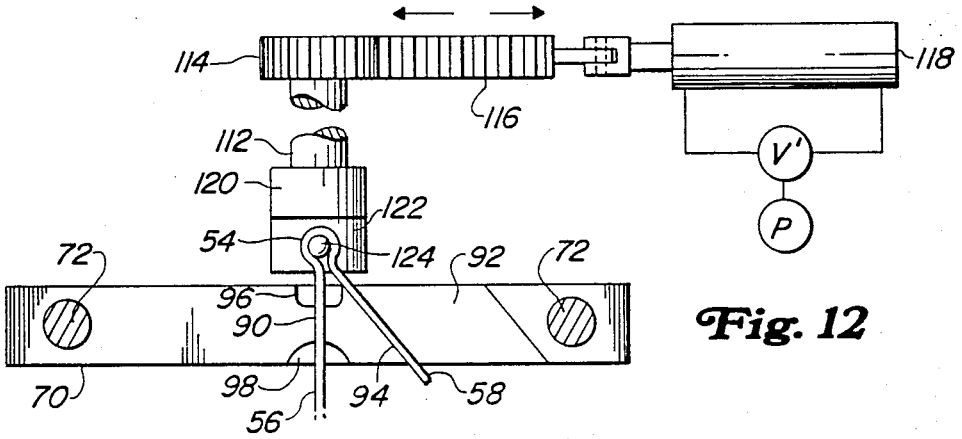
FIG. 12 is a perspective of the twister head.

FIG. 8 best depicts the twisting mechanism overall. A base 64 supports holding and guide means 66 in the form of upper and lower block-like members 68 and 70. The lower member is rigid with the base and has a pair of upright guides 72 which pass slidably through bores 74 in the upper member. An upstanding bracket 76 on the base supports a lever 78 at a pivot 80. The front end of the lever has a pin and slot connection 82 with a link or yoke 84 fixed to and rising from the upper member 68 (FIG. 11) and the rear end of the lever is linked at 86 to a power-operated device such as an air cylinder 88 which may be actuated for selectively rocking the lever 78 to raise and lower the member 68.

Figure 9:
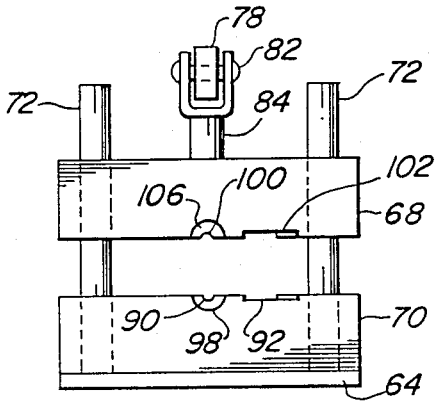
FIG. 9 is an end view of the twisting mechanism, partly in section to show the guided relationship between upper and lower wire-handling members.
Figure 10:
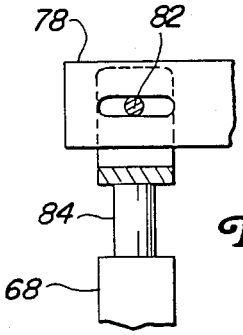
FIG. 10 is a similar view but shows the members separated.
Figure 13:
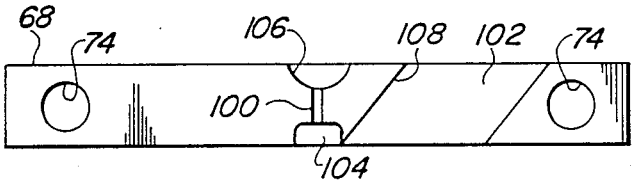
FIG. 13 is a fragmentary plan of the twister mechanism.
Figure 14:
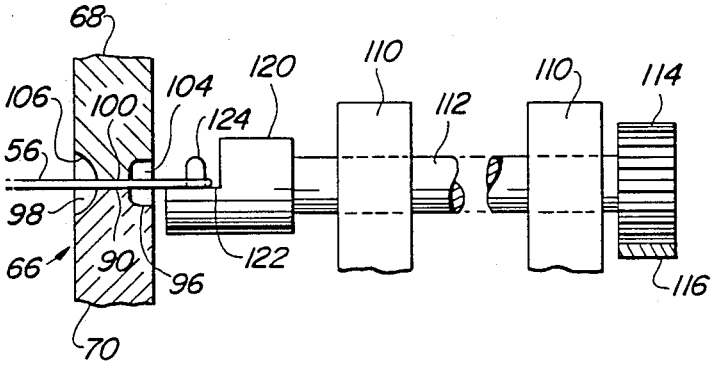
FIG. 14 is a bottom view of the upper member of FIGS. 9 and 10.
Figure 16:
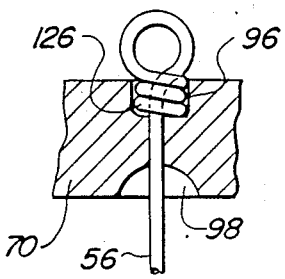
FIG. 16 is a fragmentary perspective of the bottom member of FIGS. 9 and 10 and shows the wire retaining means.

The members 68 and 70 cooperate to hold and control the V-shaped end of the formed wire (FIG. 13) and to this end the lower member 70 has a wire-receiving groove 90 for receiving the leg 56 of the wire in such fashion that the loop 54 projects rearwardly beyond the means 66. The member 70 also has a guiding recess 92 which loosely receives the wire leg 58. This recess is formed with a shoulder 94 disposed at such angle as to accommodate the wire leg 58 (FIGS. 13 and 16). In this case, the angle between the legs 56 and 58 is on the order of 40° to 60°, preferably about 45° and the angle of the shoulder to the length of the member 70 will be accordingly. When the members 68 and 70 are opened (FIG. 10), the formed wire is laid in as seen in FIG. 13. In addition to the recess 92, the member 70 has a half-cavity 96 facing rearwardly and further has another half-cavity or recess 98 facing forwardly. The upper member 68 is symmetrically formed with a wire-receiving groove 100, a recess 102 complementing the recess 92, and half-cavities 104 and 106 respectively complementing the half-cavities 96 and 98 respectively. The recess 102 has a shoulder 108 matching or complementing the shoulder in the recess 92 of the member 70. It will be understood that in FIG. 14, the member 68 is "upside down" as respects its operative position and, further that, when the two members are closed (FIG. 9) the recessed and cavity portions respectively complement each other to receive and contain the wire legs with the loop 54 projecting as aforesaid.

Rearwardly of the holding means 66 the base 64 carries a pair of bearings 110 that journal a twister shaft 112 which has a pinion 114 keyed to its rear end for operation by a reciprocating rack 116 powered by an air cylinder 118 (FIG. 13). Suitable control is provided for the cylinder. The ratio between the rack and pinion is such as to rotate the shaft through several revolutions; e.g., three. The cylinder is of course reversible to return the rack to starting position for a further cycle of the shaft. Here, as in the case of the power means for the lever 78 and shaping head 32, the details of the drive for the shaft 112 may be varied widely and form no significant part of the invention beyond the functions to achieve the desired result.

Figure 15:
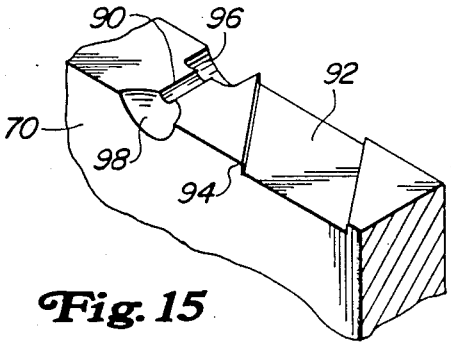
FIG. 15 is a fragmentary section generally in a vertical plane including the twisting axis and showing the wire loop engaged with the twister head.

The front end of the shaft 112 is formed with or otherwise has affixed thereto a twister head 120 having a front end configured to afford a flat 122 on the diameter of the head. A loop-receiving pin 124 rises from the flat to enter and receive the wire loop 54 (FIGS. 13 and 15). Rotation of the shaft effects a twisting operation in which the leg 58 is wrapped several times about the loop-proximate portion of the leg to form a plurality of coils 126 which are accommodated by the cavity 96–104 of the means 66 (FIG. 17), thus completing the eye 22; i.e., converting the loop to the eye. The front cavity 98–106 will accommodate the proximate bead, as will be clear without further elaboration.

In the operation of the apparatus, the modified V form of the wire is achieved as described before herein (FIGS. 2–6). The means 66 is opened and the V is laid in the bottom member 70 (FIG. 13) and the lever 78 is operated to close the members, thus confining the wire or V leg 56 to the groove 90–100 while the leg 58 is received by the recess 92–102 and the loop 54 is received by the pin on the twister head 120. The drive for rotating the shaft 112 is effectuated and the twist is formed to create the coils or turns 126. During the twisting operation the leg 58 is consumed as the wire forming the leg is drawn out of the recess 92–102. The leg 58 is thus prevented from whipping freely and is controlled to complete the wrapping to form the eye 22. After one eye is formed, the wire is removed from the apparatus and strung with beads, etc., and turned end for end to form the second eye.

Features and advantages of the invention other than those pointed out in the foregoing will have become apparent to those versed in the art, as will many modifications in the preferred embodiment disclosed, all of which may be achieved without departure from the spirit and scope of the invention.

I claim:

1. Apparatus for forming a closed eye in a length of wire, comprising: shaping mechanism for receiving a straight length of wire and including a movable element for bending the wire into the shape of a V having first and second coplanar legs converging to a rounded apex so that the legs join opposed portions of the apex respectively at radii to give the apex the form of a C-shaped loop, twisting mechanism including a holder for holding the first leg of the V so that the loop projects free of the holder, said twisting mechanism including a rotatable means engaging and twisting the loop to cause the second leg of the V to wrap around the first leg for converting the loop to a closed eye, means for driving the movable element, and means for driving the rotatable means, in which the holder is a block like-member having a top and front and rear faces, the top is configured to receive the first leg of the V with the loop projecting beyond the front face, the front face has a cavity therein coaxial with the received first leg of the V for accommodating the wrap of the second leg as the loop is twisted, and clamping means cooperating with the block-like member for confining the first leg of the V to the block-like member.

2. Apparatus according to claim 1 in which the shaping mechanism includes a pin and means for supporting the wire alongside the pin with the wire having portions projecting oppositely beyond the pin, and the movable element engages the wire at one projecting portion thereof and is angularly movable about the pin as a center for bending the wire as aforesaid.

3. Apparatus according to claim 2, in which the movable element is movable through an angular range in excess of 180°.

4. Apparatus according to claim 3, in which the angular range is on the order of 200° to 250°.

5. Apparatus according to claim 3, in which the angular range is on the order of 220°.

6. Apparatus according to claim 2, including means engageable with the portion of the wire to prevent movement thereof away from the pin during angular movement of the element.

7. Apparatus according to claim 2, including a stop engageable with the wire to limit the extent of projection beyond the pin of the wire portion engageable by the movable element.

8. Apparatus according to claim 2, in which the pin and movable element are unitarily part of a shaft from which the pin projects on the axis of the shaft and the movable element is a stud parallel to the pin and offset radially from the pin.

9. Apparatus according to claim 8, in which the offset of the stud relative to the pin provides a space in which the wire is receivable.

10. Apparatus according to claim 1, in which the rotatable twisting means is a shaft rotatable on an axis coaxial with the received first leg and having a twister head including a pin engageable with the loop.

11. Apparatus according to claim 1, in which the holder comprises a pair of relatively movable members closable to hold the first leg and separable to admit and release the first leg, at least one of said members having recess for relatively loosely accommodating the second leg.

12. Apparatus according to claim 11, in which the recess has a wall portion disposed at an angle according to the angle at which the second leg converges to the first leg.

13. Apparatus according to claim 11, including guide means cooperative between the members to guide them during opening and closing movement.

14. Apparatus according to claim 13, including power-operated means for opening and closing the members.

15. Apparatus according to claim 1, in which the rotatable means of the twisting mechanism is rotatable through several revolutions so as to provide several wraps of the second leg about the first leg.

16. Apparatus according to claim 1, in which the shaping mechanism is operative in two dupicate cycles to form the V as aforesaid.

17. An apparatus according to claim 1, in which the clamping means is configured as a mirror image of the block-like member.

* * * * *